US005172169A

United States Patent [19]

Takashima et al.

[11] Patent Number: 5,172,169

[45] Date of Patent: Dec. 15, 1992

[54] DEVELOPER CARRIER OF A DEVELOPING DEVICE AND A METHOD OF PRODUCING THE SAME

[75] Inventors: Hiroshi Takashima, Yono; Shigekazu Enoki, Kawasaki; Koji Suzuki, Yokohama; Naoki Iwata, Tokyo; Yuichi Ueno, Kawasaki, all of Japan

[73] Assignee: Ricoh Company, Ltd., Tokyo, Japan

[21] Appl. No.: 682,320

[22] Filed: Apr. 9, 1991

[30] Foreign Application Priority Data

| | | | |
|---|---|---|---|
| Apr. 9, 1990 | [JP] | Japan | 2-93590 |
| Apr. 11, 1990 | [JP] | Japan | 2-95281 |
| Jun. 4, 1990 | [JP] | Japan | 2-145976 |
| Jun. 16, 1990 | [JP] | Japan | 2-158309 |
| Mar. 19, 1991 | [JP] | Japan | 3-80847 |

[51] Int. Cl.[5] ..... G03G 15/06; G03G 13/06

[52] U.S. Cl. ..... 355/246; 355/245; 355/259; 118/651; 118/653; 118/656

[58] Field of Search ..... 355/245-246, 355/259, 77, 251, 253; 118/644, 651, 653, 656, 661, 657, 658; 29/110, 132

[56] References Cited

U.S. PATENT DOCUMENTS

| | | | |
|---|---|---|---|
| 3,284,224 | 11/1966 | Lehmann | 355/259 X |
| 4,425,382 | 1/1984 | Tajima et al. | 29/132 X |
| 4,522,907 | 6/1985 | Mitsuhashi et al. | 118/653 X |
| 4,558,943 | 12/1985 | Patz | 118/658 X |
| 4,561,381 | 12/1985 | Kaneko et al. | 118/653 X |
| 4,564,285 | 1/1986 | Yasuda et al. | 118/651 |
| 4,575,218 | 3/1986 | Sakamoto et al. | 118/651 X |
| 4,575,220 | 3/1986 | Sakamoto et al. | 118/658 X |
| 4,576,463 | 3/1986 | Sakamoto et al. | 355/259 X |
| 4,624,545 | 11/1986 | Yasuda et al. | 118/657 X |
| 4,656,964 | 4/1987 | Kanno et al. | 118/651 X |
| 4,696,255 | 9/1987 | Yano et al. | 355/259 X |
| 4,760,422 | 7/1988 | Seimiya et al. | 118/656 X |
| 4,788,570 | 11/1988 | Ogata et al. | 355/245 |
| 4,794,421 | 12/1988 | Stoudt et al. | 355/326 X |
| 4,841,331 | 6/1989 | Nakayama et al. | 355/245 |
| 4,873,940 | 10/1989 | Ishikawa et al. | 118/651 |
| 4,896,625 | 1/1990 | Sakamoto et al. | 355/259 X |
| 4,930,438 | 6/1990 | Demizu et al. | 118/651 |
| 4,982,692 | 1/1991 | Uematsu | 118/661 |

FOREIGN PATENT DOCUMENTS

| | | | |
|---|---|---|---|
| 0036245 | 4/1978 | Japan | 355/245 |
| 0053973 | 3/1985 | Japan | 355/259 |
| 0214874 | 8/1990 | Japan | 355/246 |

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

A developer carrier constituting a developing roller which carries a developer on the surface thereof where numerous microfields are developed. The developing roller has a conductive base and a plurality of different kinds of substances each having a particular charging characteristic. The different kinds of substances show themselves on the surface of the base in a regular or irregular pattern, and each is charged to a particular polarity.

53 Claims, 10 Drawing Sheets

DEVELOPER CARRIER OF A DEVELOPING DEVICE AND A METHOD OF PRODUCING THE SAME

BACKGROUND OF THE INVENTION

The present invention relates to a developing device having an image carrier and a developer carrier which face each other to define a developing region therebetween, and developing a latent image electrostatically formed on the image carrier by a developer deposited on the developer carrier. More particularly, the present invention is concerned with a developer carrier incorporated in such a developing device and a method of producing the same.

The above-described type of developing device is applicable to an electrophotographic copier, laser printer, facsimile machine or similar image forming equipment which prints out an image by developing a latent image electrostatically formed on an image carrier. The developing device uses either a two-component developer consisting of a toner and a carrier or a one-component developer which does not include a carrier. The one-component developer may contain an auxiliary agent in addition to a toner, as well known in the art. A prerequisite with the development using such a developer is that the developer be sufficiently charged and fed to the developing region in a required amount in order to form a quality image having a desired density. However, a conventional developing device cannot readily meet the above requirement and is apt to lower the image density. This is especially true when the device uses a one-component developer.

In light of this, there has been proposed a developing device having a developer carrier on which a charge holding layer is formed, and a fur brush roller, sponge roller or similar charging member held in contact with the charge holding layer, as disclosed in Japanese Patent Laid-Open Publication No. 43767/1986. The charge holding layer and the charging member are charged to opposite polarities by friction. A developer charged to a polarity opposite to the polarity of the charge holding layer is electrostatically deposited on the layer and transported to the developing region. With this implementation, however, it is impossible to produce sufficiently intense electric fields in the vicinity of the charge holding layer. Hence, it is not easy to deposit a developer great enough in amount to form an image having a high density on the surface of the developer carrier.

The developer carrier may be formed with undulations on the surface thereof, as taught in Japanese Patent Laid-Open Publication No. 53976/1985. This kind of approach is successful in transporting a greater amount of developer to the developing region since the developer will be filled in the undulations. However, the problem is that a substantial amount of the developer being transported is not sufficiently charged and is, therefore, apt to degrade the image quality.

SUMMARY OF THE INVENTION

It is therefore an object of the present invention to provide a developing device capable of forming quality images by depositing a required amount of sufficiently charged developer on a developer carrier.

It is another object of the present invention to provide an image carrier capable of carrying a required amount of sufficiently charged toner thereon.

It is another object of the present invention to provide a method of producing a developer carrier capable of carrying a required amount of sufficiently charged toner thereon.

In one aspect of the present invention, a developer carrier for carrying a developer on the surface thereof where numerous microfields are developed comprises a conductive base, and a plurality of kinds of substances each having a particular charging characteristic and being exposed to the outside on the surface of the conductive base in a predetermined pattern. The plurality of kinds of substances are charged in a predetermined manner to produce the numerous microfields in the vicinity of the surface of the developer carrier. The microfields define attracting portions which attract the developer and repulsing portions which repulse the toner on the surface of the developer carrier.

In another aspect of the present invention, a developing device for supplying a developer to a developing region of an image carrier to develop a latent image electrostatically formed on the image carrier comprises a developer carrier comprising a conductive base and a plurality of kinds of substances each having a particular charging characteristic and being exposed to the outside on the surface of the conductive base in a predetermined pattern. The plurality of kinds of substances are charged in a predetermined manner to thereby produce numerous microfields in the vicinity of the surface of the developer carrier. The microfields define attracting portions which attract the developer and repulsing portions which repulse the toner. A charging member charges the plurality of kinds of substances of the developer carrier.

In still another aspect of the present invention, a developer carrier for carrying a developer on the surface thereof where numerous microfields are developed comprises a conductive base, a first substance provided in a layer on the surface of the conductive base, and a second substance different in charging characteristic from the first substance and dispersed on the first substance in a predetermined patterns.

In a further aspect of the present invention, a method of producing a developer carrier for carrying a developer on the surface thereof where numerous microfields are developed comprises the steps of applying the photosensitive first substance to the surface of a conductive base, irradiating the first substance by light which causes photobridging to occur in the first substance via a contact screen, removing portions of the first substance not undergone photobridging by rinsing, applying a second substance to the surface of the first substance, and grinding the surface of the second substance after the substance has been hardened.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
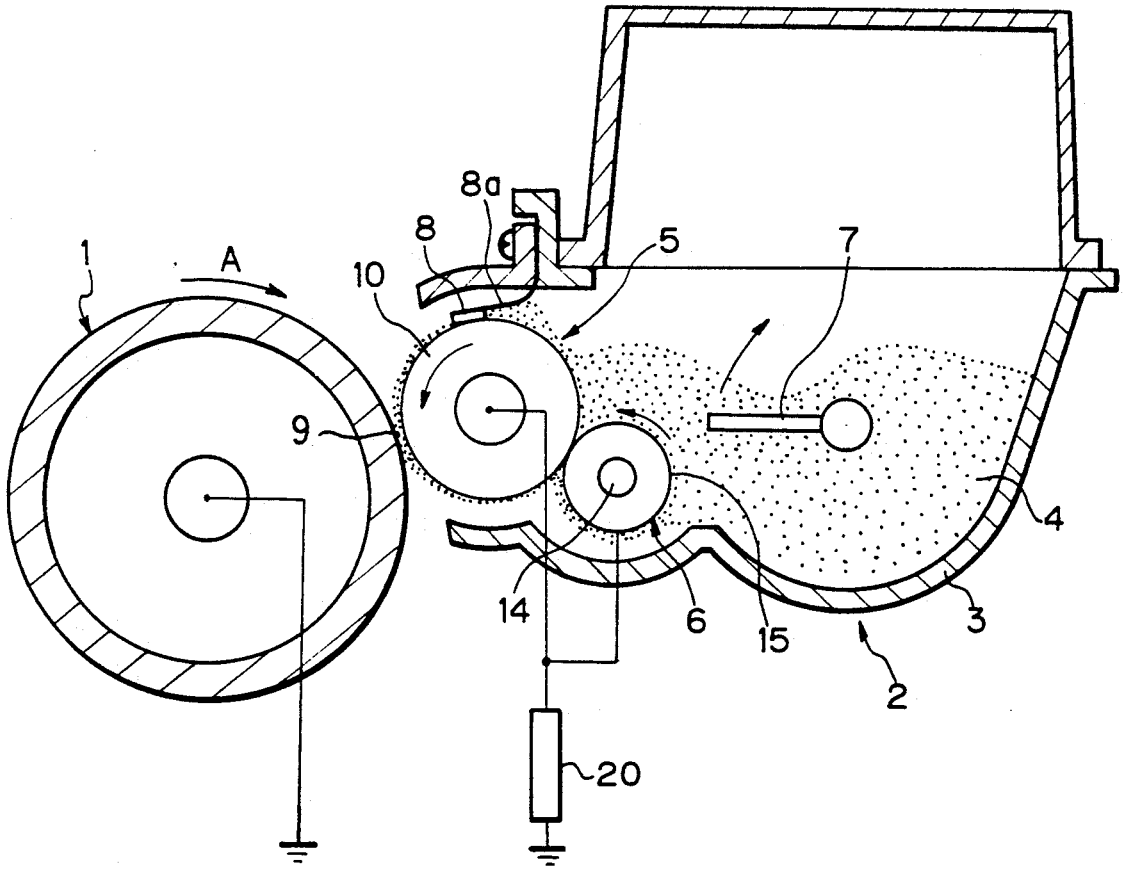
FIG. 1 is a section showing a developing device embodying the present invention.

Referring to FIG. 1 of the drawings, a developing device embodying the present invention is shown and generally designated by the reference numeral 2. As shown, the developing device 1 is located to face a photoconductive element 1 which is implemented as a drum and rotatable in a direction indicated by an arrow A. The developing device 1 has a casing 3 storing a developer therein. In the illustrative embodiment, use is made of a non-magnetic one-component developer, i.e., a non-magnetic toner 4 with or without an auxiliary agent. The toner has a specific volume resistivity of, for example, $10^7$ Ω·cm to $10^{12}$ Ω·cm. A developing roller 5 is journalled to opposite side walls of the casing 3 and partly exposed to the outside through an opening formed through the casing 3. The developing roller 5 faces the drum 1 and rotates counterclockwise as viewed in the figure. Of course, the photoconductive element 1 may be implemented as a belt. A toner supply roller 6 which is a specific form of a developer supply member is also journalled to the side walls of the casing 3 and rotatable counterclockwise, for example, in contact with the developing roller 5. The toner 4 stored in the casing 3 is moved toward the toner supply roller 6 by an agitator which is driven in the clockwise direction, while being agitated by the agitator 7. At this instant, the toner is charged to positive or negative polarity by friction and thereby electrostatically deposited on the periphery of the developing roller 5, as will be described more specifically later.

While the toner deposited on the developing roller 5 as stated above is transported by the roller 5, a doctor blade 8 resiliently pressed against the roller 5 regulates the toner to a predetermined thickness. The doctor blade 8 is a specific form of a thickness regulating member and is mounted on a support member 8*a* which may be implemented by a thin sheet of stainless steel, for example. When the toner reaches a developing region 9 where the drum 1 and roller 5 face each other, it is electrostatically transferred from the roller 5 to a latent image electrostatically formed on the drum 1 to thereby develop the latent image. While the embodiment is implemented with so-called non-contact development, i.e., a small gap is defined between the drum 1 and the roller 5, the drum 1 and roller 5 may be held in contact with each other through the toner to effect so-called contact development (see FIG. 15). Part of the toner moved away from the developing region 9 without being transferred to the drum 1 is returned to the toner supply roller 6 by the developing roller 5. The developed image or toner image formed on the drum 1 is transferred to a paper sheet, not shown, and then fixed on the paper sheet by a fixing device, not shown.

The developing device 2 is similar to a conventional developing device so far as the arrangement wherein the developing roller 5 faces the drum 1 in the developing region 9 and develops a latent image by the toner 4 is concerned. However, the embodiment is unique in the following aspects.

With the conventional developing device, it is difficult to transport a great amount of sufficiently charged toner to the developing region. Especially, a developing device of the type using a non-magnetic toner cannot cause the toner to deposit on a developing roller by magnetism. Therefore, the amount of toner which can be fed to the developing region is short, resulting in a low image density. A developing device using a color toner, among others, has to deposit a great amount of toner on a developing roller in order to form a toner image of predetermined density. Such a developing device having a conventional construction cannot produce a color image of high density. In the illustrative embodiment, the developing roller 5 has a conductive base, and a charge holding layer formed on the conductive base. The charge holding layer has a plurality of different kinds of substances each having a particular charging characteristic therein. Such substances are exposed to the outside in a regular or irregular pattern, and at least one of them is charged by charging means to a polarity different from or identical with the polarity of the toner. In this configuration, a great amount of closed microfields are developed in the vicinity of the surface of the developing roller 5, i.e., charge holding layer, whereby a great amount of toner is deposited on the surface of the developing roller.

The different kinds of substances mentioned above may be charged in any of the following manners:

(1) charging the substances each having a particular charging characteristic to different polarities;

(2) charging at least one kind of substance and substantially not charging at least another kind of substance; and (3) charging the substances to the same polarity, but to different potentials.

The schemes (1) to (3) stated above will be referred to as a first to a third construction for convenience and described specifically hereinafter.

Figure 2:
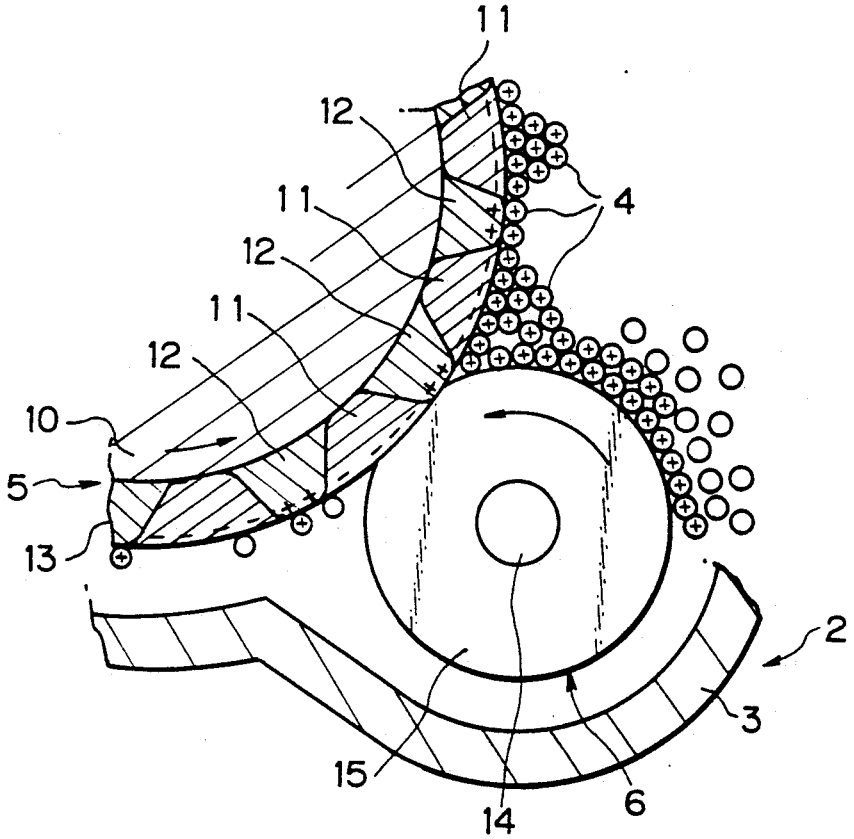
FIG. 2 is a fragmentary enlarged section showing first and second dielectric substances of a developing roller included in the embodiment, together with toner particles.
Figure 3:
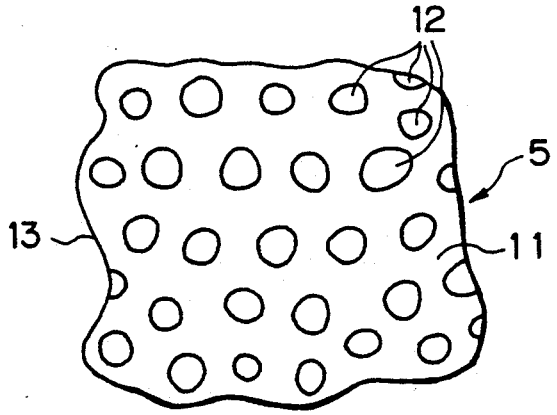
FIG. 3 is a fragmentary enlarged plan view of the surface of the developing roller.
Figure 4:
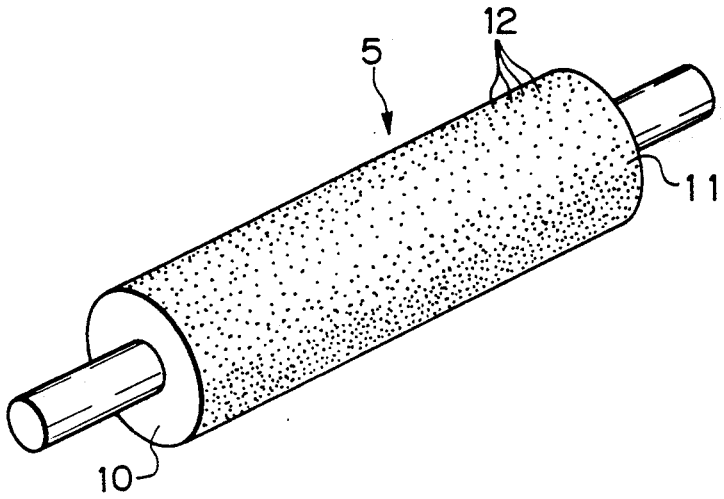
FIG. 4 is a perspective view of the developing roller.

As shown in FIG. 2, in the first construction, the developing roller 5 has a conductive base 10 which is implemented by, for example, an aluminum tube or a conductive roller made of copper, soft iron, cast iron, stainless steel, ferrite or similar magnetic or non-magnetic material. As also shown in FIG. 3, a first and a second substance 11 and 12 each having a particular frictional charging characteristic are affixed to the surface of the conductive base 10. The substances 11 and 12 show themselves on the surface of the base 10 in a regular or irregular pattern (FIG. 4). It is to be noted that the word "substances" each having a particular charging characteristic refers to substances which, when charged as will be described, can hold the charge until they reach the developing region 9, i.e. so-called dielectric substances. More specifically, the "substances" each should preferably have a specific volume resistivity higher than $10^5$ Ω·cm, more preferably $10^{12}$ Ω·cm, in order to retain the charge surely thereon. Adequate substances are selected in consideration of frictional charging characteristic and durability, as will be described later. The substances 11 and 12 which will sometimes be referred to as dielectric substances hereinafter constitute a charge holding layer 13 having a predetermined thickness.

In the first construction, the dielectric substances 11 and 12 are selected such that they are charged to opposite polarities when charged by friction. For example, the dielectric substance 11 is Teflon (trade name) or similar fluoric resin, while the dielectric substance 12 is polycarbonate which is positioned on the more positive side than fluoric resin. While only two substances 11 and 12 each having a particular charging characteristic are provided on the developing roller 5, three or more substances which are different in charging characteristic may be provided on the roller 5. This is also true with all of the embodiments which will be described.

The first construction of the developing roller 5 is achievable when, for example, a substance for constituting the second dielectric substance 12 is sprayed onto the conductive base in such a manner as to form microscopic undulations on the surface thereof, it is dried, a substance for constituting the first dielectric substance 11, i.e., fluoric resin is applied from above the second substance 12, it is dried, and then the entire periphery of the resulted laminate is ground in a cylindrical configuration. In such a roller 5, the fractions of the second dielectric substance 12 different in charging characteristic from the first dielectric substance 11 are distributed in the latter, as shown in FIGS. 3 and 4. The fractions of the second dielectric substance 12 exposed to the outside each has a diameter of, for example 30 μm to 2,000 μm, preferably about 50 μm to about 500 μm. Further, such fractions occupy, for example, 10% to 60% of the entire surface of the developing roller 5 in terms of area ratio. Stated another way, the surface of the first dielectric substance 11 occupies 40% to 90% of the entire surface of the developing roller 5. In this connection, the toner particles have a particle size ranging from about 5 μm to about 20 μm, for example. Such numerical values are adequately selected such that the intensity of closed microfields which will be described is increased to allow the toner to deposit on the roller surface in a uniform layer along the microfields. When use is made of fluoric resin, the toner is prevented from filming on the surface of the developing roller 5 due to the non-adhesion effect particular to such resin. This is successful in extending the life of the developing roller 5.

In this embodiment, the toner supply roller 6 serves to charge the first and second dielectric substances 11 and 12 provided on the developing roller 5. Specifically, the toner supply roller 6 has a conductive core member 14, and a cylindrical foamed body 15 surrounding the core member 14 and pressing itself against the developing roller 5 while deforming elastically. The foamed body 15 is constituted by a substance which frictionally charges the first dielectric substance 11 to negative polarity and the second dielectric substance 12 to positive polarity. The foamed body 15 assumes an intermediate position between the first and second dielectric substances 11 and 12 with respect to the frictional charging series and, in the illustrative embodiment, comprises foam polyurethane. A charge control agent may be added to foam polyurethane, if desired. The foamed body 15 may be replaced with a number of fur brushes which are implanted on the core member 14 and held in contact with the developing roller 5 (see FIG. 9). Then, the fur brushes will also be made of polyurethane or polyethylene or polystyrene. The foamed body 15 or the fur brushes may be treated to have conductivity. The developing roller 5 with fur brushes will reduce the force which the developing roller 5 exerts on the toner supply roller 6 and, therefore, the torque for driving the roller 6.

In operation, the part of the developing roller 5 moved away from the developing region 9 is caused to contact the toner supply roller 6, as stated earlier with reference to FIG. 1. Toner particles remaining on the developing roller 5 without contributing to the developing are scraped of by a scavenging force exerted by the toner supply roller 6. At the same time, the second dielectric substance 12 is positively charged in frictional contact with the toner supply roller 6. That is, the dielectric substance 12 is different from the toner supply roller 6 with respect to the charging series and, therefore, intensely charged to the positive polarity. On the other hand, the first dielectric substance 11 is negatively charged in contact with the toner supply roller 6. The toner 4 being fed toward the developing roller in contact with the toner supply roller 6 is frictionally charged to a predetermined polarity by the roller 6. While the polarity to which the toner is charged depends on the relation between the substance constituting the toner and the substances constituting the surfaces of the rollers 5 and 6 with respect to the frictional charging series, it is assumed to be positive polarity hereinafter.

Figure 5:
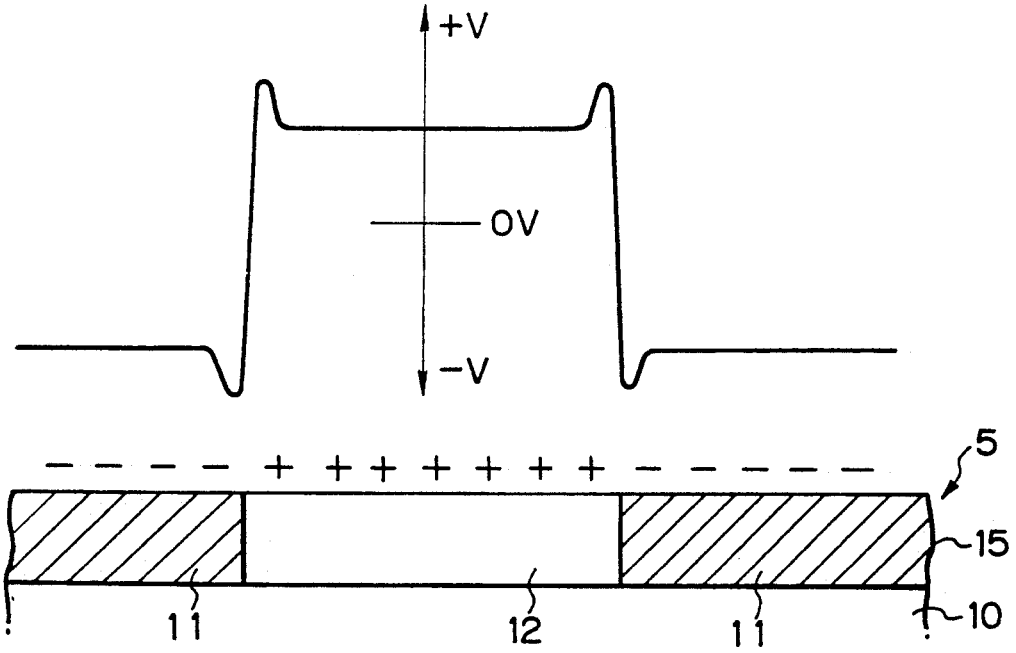
FIG. 5 plots a surface potential distribution particular to the first and second dielectric substances.

As shown in FIG. 5, the first and second dielectric substances 11 and 12 charged to opposite polarities as stated above are noticably different in potential from each other. Moreover, since the dielectric substances 11 and 12 adjoin each other on the surface of the developing roller 5, they produce closed electric fields as represented by electric lines of force E in FIG. 6. More specifically, since the surfaces of the dielectric substances 11 and 12 each has a small area and adjoins the other, almost infinite number of closed microfields are developed in the space adjacent to the surface of the developing roller 5. The electric lines of force E each extends from the developing roller 5 and returns to the same.

Since the first and second dielectric substances 11 and 12 each has a small area and adjoins the other, as stated above, the microfields each is extremely intense due to the so-called edge effect or fringing effect. As a result, the positively charged toner 4 is strongly attracted toward the surface of the negatively charged first dielectric substance 11 and firmly retained in a great amount on the surface on the surface of the developing roller 5. The developing roller 5, therefore, carries a considerable amount of toner 4 thereon, compared to a conventional developing roller having a uniform dielectric layer. Since the toner is intensely charged by the friction thereof with the rollers 5 and 6 and retained on the surface of the roller 5 by the intense microfields, a great amount of intensely charged toner is deposited on the roller 5. When the toner so retained on the developing roller 5 is regulated in thickness by the doctor blade 8 made of urethane, for example, toner particles sufficiently charged are firmly retained on the roller 5. Even if toner particles which are not sufficiently charged exist among the sufficient charges particles, they are removed by the doctor blade 8 and, therefore, only the sufficiently charged particles are transported in a great amount to the developing region 9. The dielectric substances 11 and 12 each holds the charge thereof even when it reaches the developing region 9. In the developing region 9, the electric lines of force extending from the latent image on the drum 1 center around the edges of the dielectric substances 11 and 12, providing the resultant image with high resolution.

Figure 6:
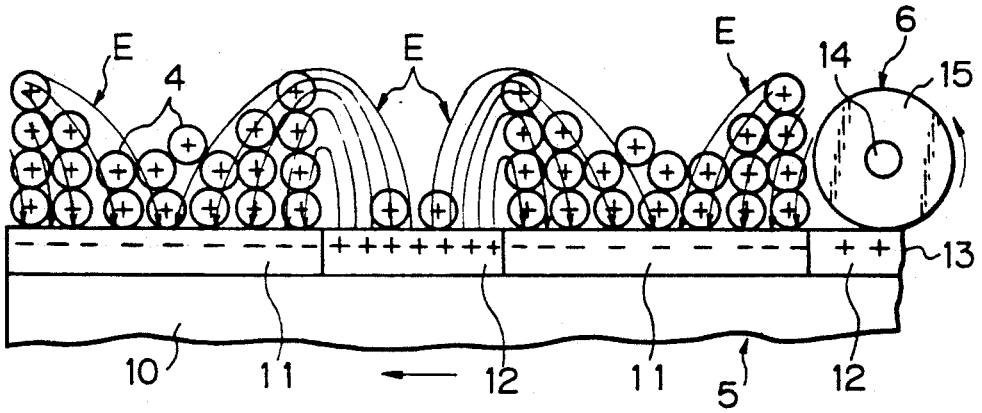
FIGS. 6, 7 and 8 each is a schematic view showing closed microfields developed in the vicinity of the surface of the developing roller and toner particles deposited on the roller.

As shown in FIG. 6, the microfields developed in the vicinity of the surface portion of the developing roller 5 which has just been charged by the toner supply roller 6 are sometimes only closed microfields and sometimes a mixture of closed and nonclosed microfields. In any case, the intense electric fields allow a great amount of toner to deposit on the developing roller 5.

As stated above, in the first construction, the dielectric substances 11 and 12 each having a particular charging characteristic are charged to opposite polarities to develop numerous closed microfields in the vicinity of the surface of the developing roller 5. Such microfields cause a great amount of toner to deposit on the surface of the roller 5. At this instant, the toner positively deposit on the surface of the first dielectric substance 11 having been charged to the opposite polarity to the toner 4. On the other hand, the surface of the second dielectric substance 12 having been charged to the same polarity as the toner repulses the toner, but some toner 4 deposits on the dielectric substance 12 due to van der Waals' forces ascribable to the surface of the developing roller 5.

In the illustrative embodiment, the surface of the second dielectric substance 12 that repulses the toner occupies 10% to 60% of the entire surface of the developing roller 5 in terms of area ratio, while the surface of the first dielectric substance 11 that attracts the toner occupies 40% to 90% of the same, as stated previously. Providing the portion that attracts the toner with a comparatively large area allows the great amount of toner to be distributed regularly throughout the surface of the developing roller 5. Moreover, since the fractions of the second dielectric substance 12 each has an area of 20 μm to 2,000 μm, particularly 50 μm to 500 μm as measured on the surface of the developing roller 5, the toner whose particle size is 5 μm to 20 μm can deposit substantially uniformly on the developing roller.

A conventional developing device can deposit only about 0.1 mg/cm$^2$ to 0.3 mg/cm$^2$ of toner on the surface of a developing roller which has moved away from a doctor blade. Therefore, the amount of toner deposited on the developing roller is short, especially when use is made of a color toner. To eliminate this problem, it has been customary to rotate the developing roller at a speed which is about three to four times as high as the linear velocity of a photoconductive element, so that a greater amount of toner may be fed to a developing region. This, however, brings about another problem that, when it comes to a solid image, the density is unusually high at a trailing edge of portion of the image, compared to the other portions, degrading the image quality. This problem is especially serious in the case of a color image since the difference in density directly translates into a difference in color. In light of this, the developing roller may be moved at the same or substantially the same linear velocity as the photoconductive element. This, however, requires an amount of toner as great as 0.3 mg/cm$^2$, particularly 0.8 mg/cm$^2$ to 1.2 mg/cm$^2$ in the case of a color toner, to deposit on the developing roller. Such an amount of toner deposition is not achievable with the conventional developing device. By contrast, the illustrative embodiment allows a great amount of toner (e.g. greater than 0.3 mg/cm$^2$, particularly greater than 0.8 mg/cm$^2$ to 1.2 mg/cm$^2$) having been charged to about 5 μc/g to about 20 μc/g (preferably 8 μc/g to 15 μc/g) to be transported to the developing region, thereby freeing the background of an image from contamination and increasing the sharpness of the image. Hence, even when the linear velocity of the developing roller 5 is equal to or approximate to the that of the drum 1, a sufficiently high image density is attainable and the irregular toner distribution stated above is eliminated. As a result, the resolution of an image is increased to enhance the quality of a color image.

The developing roller 5 having the above configuration insures desirable reproducibility even when the image printed on a document is in the form of a dot pattern.

A bias voltage may be applied from a power source 20, FIG. 1, to the conductive base 10 of the developing roller at the beginning of development in order to free the background of a toner image from contamination, as known in the art. The bias voltage causes the toner to be transferred to the latent image which is or is not held in contact with the developing roller. The bias voltage may be DC identical in polarity with the latent image or DC on which an alternating voltage (e.g. AC or pulse voltage) is superposed. For example, in the device shown in FIG. 1, when a pulse voltage having a rectangular wave and a frequency of 300 Hz to 2,000 Hz, preferably 500 Hz to 1,500 Hz, is applied to the developing roller 5 in addition to a current voltage, a clear-cut toner image is achievable. When such a voltage is not applied to the developing roller 5, the roller 5 may be provided with an insulative base in place of the conductive base 10.

When an alternating voltage inclusive of a pulse voltage, especially an alternating voltage having a great peak-to-peak value, is applied to the developing roller, a conventional developing device would cause the charge to leak between a developing roller and a photoconductive element thereof and would thereby disturb a latent image to produce a partly omitted toner image. In the illustrative embodiment, the surface of the developing roller 5 is constituted by the dielectric substances 11 and 12, i.e., the conductive base 10 is not exposed to the outside. Hence, even when an alternating voltage or superposed AC-DC bias voltage is applied to between the developing roller 5 and the drum 1, discharge does not occur between the roller 5 and the drum 1. This prevents the latent image from being disturbed and, therefore, eliminates a locally omitted or similar defective image. Consequently, a sufficiently high bias voltage can be applied to the developing roller 5.

Figure 7:
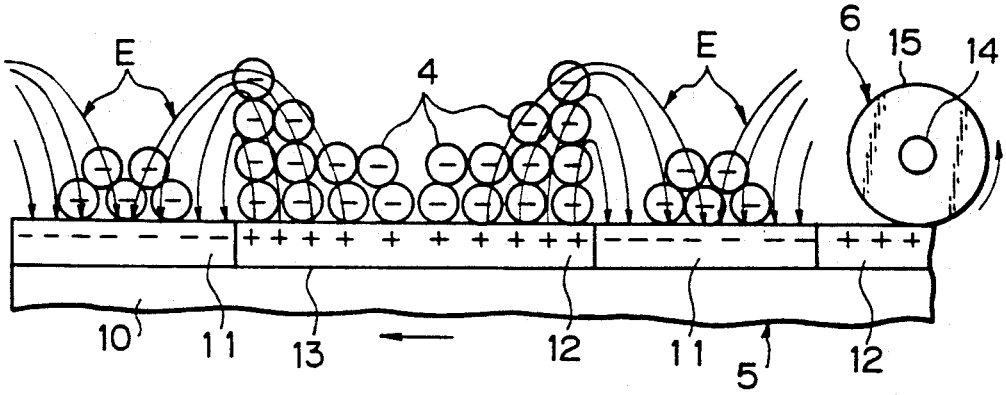

While the toner 4 has been described as being positively charged and deposited on the negatively charged first dielectric substance, it may, of course, be negatively charged and deposited on the positively charged second dielectric substance 12, as shown in FIG. 7. In this case, since the first dielectric substance 11 is the portion which electrostatically repulses the toner, it is preferable that the first dielectric substance 11 occupies 10% to 60% of the entire surface of the roller 5, i.e., the second dielectric substance 12 that attracts the toner 4 occupies a greater area to collect a greater amount of toner.

Figure 8:
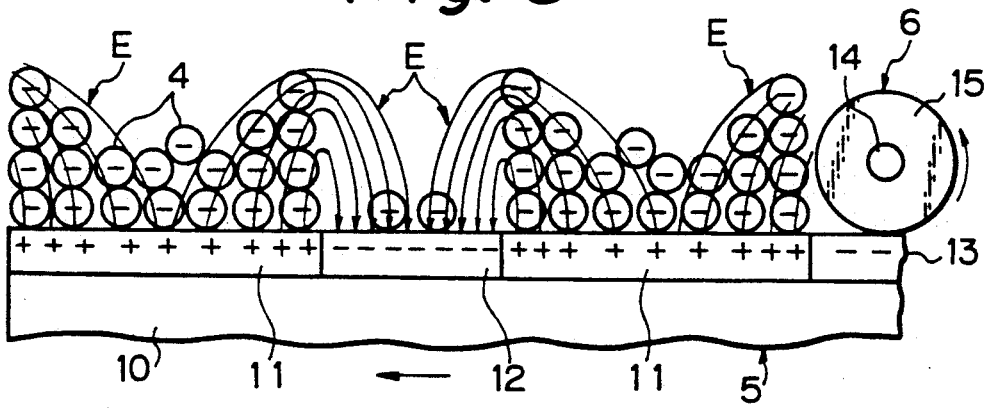

It should be noted that the above-described materials constituting the first and second dielectric substances 11 and 12 and toner supply roller 6 are only illustrative and may be replaced with other suitable materials. For example, as shown in FIG. 8, the first and second dielectric substances 11 and 12 may be comprised of polycarbonate and fluoric resin such as Teflon, respectively, Teflon being dispersed in polycarbonate. Then, the toner supply roller 6 made of polystyrene, polyethylene or polyurethane may charge the first dielectric substance 11 to positive polarity and the second dielectric substance 12 to negative polarity. In this condition, the toner 4 charged to negative polarity, for example, will be retained in a great amount on the surface of the dielectric substance 11 and in a small amount on the surface of the dielectric substance 12. At this time, the second dielectric substance 12 repulses the toner and, therefore, should occupy 10% to 60% of the entire surface of the developing roller 5. This kind of developing roller can also be produced by spraying Teflon onto the surface of the conductive base in such a manner as to form microscopic undulations, applying polycarbonate, drying the laminate, and then grinding the laminate to expose the dielectric substances 11 and 12 to the outside. The fractions of second dielectric substance or Teflon 12 which are exposed to the outside each has a diameter of 30 μm to 2,000 μm, preferably 50 μm to 500 μm. The toner whose particle size ranges from 5 μm to 20 μm and negatively charged is firmly retained on the surface of the first dielectric substance or polycarbonate 11, while it is repulsed by the second dielectric substance or Teflon and retained in a small amount thereon.

Regarding the rest of the construction, the embodiment shown in FIG. 8 is essentially the same as the embodiment previously described with reference to FIGS. 1 to 6.

Alternatively, the dielectric substances 11 and 12 may be implemented by silicone resin and Teflon, respectively, while the toner supply member 6 may be implemented by foam urethane. Then, the toner supply member 6 may charge the silicone resin and Teflon to positive polarity and negative polarity, respectively, so as to collect the negatively charged toner, for example, on the surface of the silicone resin. Further, the dielectric substances 11 and 12 may be respectively constituted by silicone resin and polystyrene and charged positively and negatively. Then, the toner charged to negative polarity, for example, will be attracted onto the surface of the silicone resin. Again, it is desirable that the dielectric substance which repulses the toner occupies 10% to 60% of the entire surface of the developing roller 5.

Figure 9:
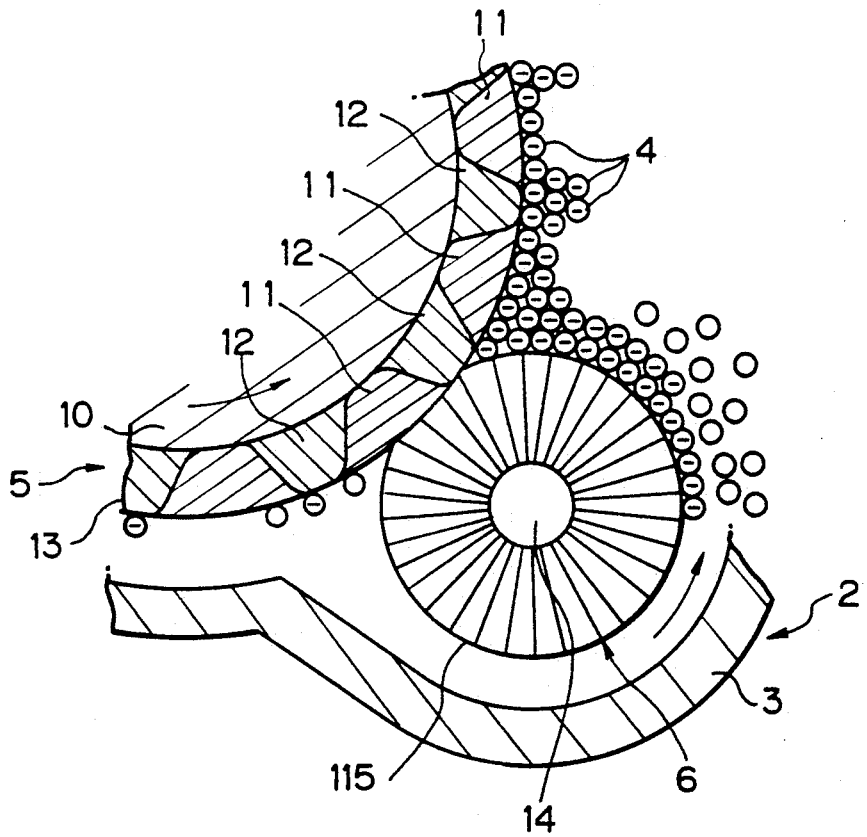
FIG. 9 is a view similar to FIG. 2, showing an alternative embodiment of the present invention.
Figure 10:
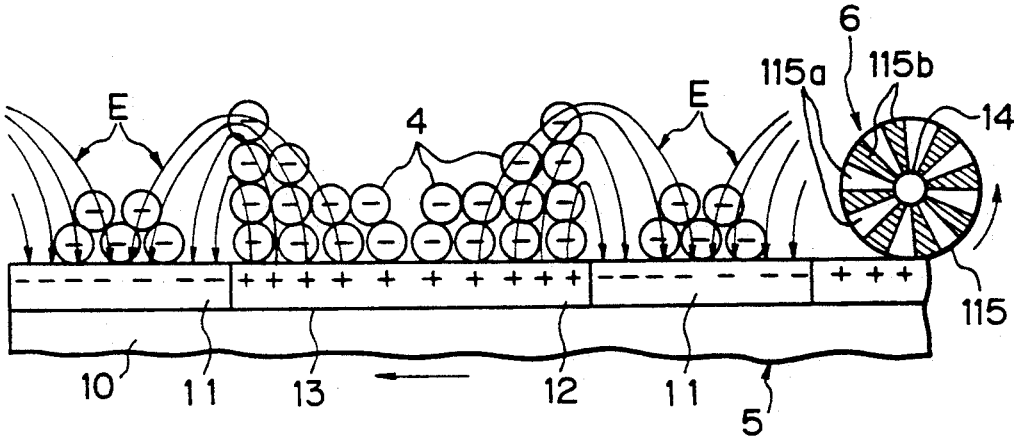
FIGS. 10 and 11 each is a schematic view showing closed microfields developed in the vicinity of the surface of a developing roller and a toner attracted thereby.

In the embodiments shown and described, the toner supply roller, or charging means, 6 has the foamed body 15 thereof entirely constituted by the same substance and frictionally charges the two difference dielectric substances 11 and 12 of the developing roller 5 to opposite polarities. Alternatively, the toner supply roller 6 may be made up of at least two different substances each having a particular frictional charging characteristic. For example, FIG. 9 shows the toner supply roller 6 having a core member 14 and a number of fur brushes 115 which are affixed to the core member 14 at one end thereof. In FIG. 9, the developing roller 5, like the developing roller 5 of FIG. 6, has the first and second dielectric substances 11 and 12 respectively implemented by Teflon and polycarbonate which is positioned on the more positive side than Teflon with respect to the frictional charging series. The second dielectric substance 12 may comprise polyethylene or polystyrene, if desired. Regarding the toner supply roller 6, the fur brushes 115 are constituted by two different kinds of fibers each having a particular frictional charging characteristic, e.g. nylon and Teflon. Such nylon and Teflon fibers are studded on the core member 14 in combination and contact the surface of the developing roller. Such a configuration of the toner supply roller, or fur brush roller, 6 is schematically shown in FIG. 10. As shown, the toner supply roller 6 has nylon fur brushes **115*a* and Teflon fur brushes 115*b*** indicated by hatching for distinction. The rest of the construction is the same as the previous embodiments.

The toner supply roller 6 in rotation contacts the surface of the developing roller 5 to frictionally charge the first and second dielectric substances 11 and 12 to negative polarity and positive polarity, respectively. Specifically, the nylon fur brushes **115*a*, for example, frictionally charge the first dielectric substance 11, for example, which is made of fluoric resin. As a result, the dielectric substance 11 is greater than the second dielectric substance 12 in the amount of negative charge, as shown in FIG. 10. On the other hand, the Teflon brush 115*b*, for example, frictionally charges the second dielectric substance 12 to positive polarity. In this manner, substances which are remotest from each other with respect to work function ranking contact each other to cause frictional contact to occur. Consequently, numerous closed microfields E are developed in the vicinity of the surface of the developing roller 5, as in the previous embodiments. The toner 4 fed to the developing roller 5 in contact with the toner supply roller 6 is negatively charged by the roller 5. Such a toner is strongly attracted onto the surface of the second dielectric substance 12 due to the microfields E. Hence, a great amount of toner is deposited on the developing roller 5** to insure high image quality.

As stated above, the toner supply roller 6 is constituted by two different substances each having a particular frictional charging characteristic and positively charging the dielectric substance 11 or 12 positively or negatively by friction. This increases the potential difference between the dielectric substances 11 and 12 and thereby the amount of toner deposition. When all the fur brushes 115 are made of a single substance such as polystyrene and held in contact with the dielectric substances 11 and 12, the resultant potential difference between the substances 11 and 12 is smaller than the potential difference achievable with the above-described two-substance configuration, slightly reducing the attraction acting on the toner. In FIGS. 9 and 10, the toner is negatively charged. Alternatively, it may be positively charged so as to deposit in a great amount on the dielectric substance of the developing roller 5 which has been charged to the other polarity. In any case, the dielectric substance that repulses the toner should preferably occupy 10% to 60% of the entire surface of the developing roller 5. When the surface of the developing roller 5 is constituted by three or more different kinds of dielectric substances, the toner supply roller 6 may also be constituted by three or more different kinds of dielectric substances. When the toner supply roller 6 is implemented with the foamed roller 15 as shown in FIG. 1, the foamed roller 15 may be implemented by at least two different dielectric substances each having a particular frictional charging characteristic.

A series of experiments were conducted with the above-described embodiments pertaining to the first construction, as follows.

Experiment 1

An organic photoconductive element in the for of the drum 1 was used as an image carrier. Negative-to-positive development was effected by a negatively charged toner. The developing roller 5 and the drum 1 were spaced apart by a distance of 100 μm and rotated at the same linear velocity of 150 mm/sec. A DC-superposed pulse bias was applied to the developing roller 5. The pulse bias had a 50 V voltage portion and a −800 V voltage portion and a frequency of 750 Hz. The developing roller 5 was produced by spraying polycarbonate onto an aluminum tube in such a manner as to form undulations whose mean thickness was 100 μm, applying fluoric resin, and then grinding the laminate such that the dielectric layer is 10 μm thick. The resulted fractions of polycarbonate occupied 65% of the entire surface of the developing roller 5 in area ratio. The toner supply roller 6 was made of foam polyurethane rubber treated for conduction, while the doctor blade 8 was implemented by a urethane rubber blade. Such a configuration successfully formed on the developing roller 5 a uniform toner layer having a mass of 1.1 mg/cm$^2$ and an amount of charge of −12 μc/g and thereby produced images having desirable tones and clear-cut lines.

Experiment 2

The same image carrier as in Experiment 1 was used, and positive-to-positive development was effected by a positively charged toner. The developing roller 5 and drum 1 were spaced apart by the same distance and moved as the same linear velocity as in Experiment 1. The DC-superposed pulse bias applied to the roller 5 had a +150 V voltage portion and a −700 V voltage portion and a frequency of 750 Hz. The developing roller 5 was produced by the same procedure as in Experiment 1 except that Teflon was substituted for fluoric resin. Polycarbonate occupied 25% of the entire surface of the developing roller 5 in area ratio. The toner supply roller 6 was implemented as a polystyrene brush, while the doctor blade 8 was constituted by a urethane rubber blade. As a result, a uniform toner layer having a mass of 1.0 mg/cm$^2$ and an amount of charge of +14 μc/g was formed on the developing roller 5 and produced images having desirable tones and clear-cut lines.

Experiment 3

This experiment was conducted under essentially the same conditions as Experiment 1 except for the following conditions. Specifically, Teflon was sprayed onto an aluminum tube in place of polycarbonate, and then polycarbonate was applied in place of fluoric resin. Teflon occupied 25% of the entire surface of the developing roller 5. The toner supply roller 6 was implemented by a polystyrene brush, while the doctor blade 8 is constituted by a urethane rubber blade. A uniform toner layer having a mass of 1.0 m/cm$^2$ and an amount of charge of −14 μc/g was formed on the developing roller 5. Such a toner layer was also successful in producing images having excellent tones and clear-cut lines.

Experiment 4

An organic photoconductive element in the form of the drum 1 was used as an image carrier and uniformly charged to negative polarity. Then, the charged drum 1 was irradiated by a laser beam to locally lower the charge thereof, whereby a latent image was electrostatically formed. A negatively charged toner was deposited on the developing roller 5 and effected negative-to-positive development with the latent image. The developing roller 5 and drum 1 were spaced apart from each other by a gap of 100 μm and driven at the same linear speed of 150 mm/sec. A DC-superposed pulse bias voltage having a 150 V peak voltage and a −800 V peak voltage and a frequency of 750 Hz was applied to the developing roller 5. The configuration of the developing roller 5 was the same as in Experiment 1. Polycarbonate (second dielectric substance 12) occupied 65% of the entire surface of the developing roller 5. The toner supply roller was implemented as the fur brush roller 6 which was a 1:1 mixture of fibers of Teflon and nylon. The thickness regulating member was constituted by the doctor blade 8 which was made of urethane rubber and held in contact with the developing roller 5. Under these conditions, a uniform toner layer having a mass of 1.2 mg/cm$^2$ and an amount of charge of −15 μc/g was formed on the developing roller 5 and produced images having desirable tones and clear-cut lines.

In the first construction described above, at least two of a plurality of different kinds of substances (dielectric substances) each having a particular charging characteristic and provided on the developing roller are charged to opposite polarities. As a result, the developing roller has portions which attract the toner and portions which repulse it, so that numerous microfields are developed in the vicinity of the roller surface to retain a great amount of toner on the roller. In the second construction which will be described, at least one of a plurality different kinds of substances (dielectric substances) each having a particular charging characteristic and distributed regularly or irregularly on the surface of the developing roller 5 is charged by charging means to produce numerous microfields in the vicinity of the roller surface. In such a configuration, the intensity with which the individual microfields attract the toner depends on the substance.

Figure 11:
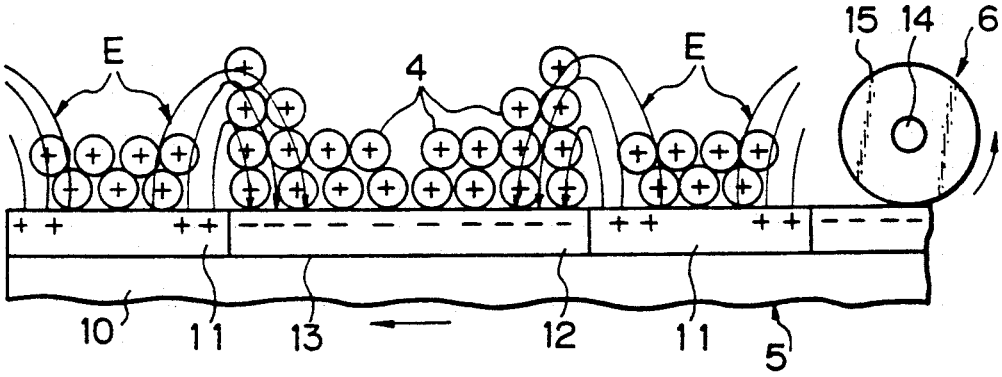

Specifically, as shown in FIG. 11, the charge holding layer 13 formed on the conductive base 10 of the developing roller 5 is made up of a plurality of different kinds of substances, i.e., polystyrene constituting the first dielectric substance 11 and Teflon, i.e., fluoric resin dispersed in polystyrene and constituting the second dielectric substance 12. These substances 11 and 12 are distributed on the surface of the developing roller 5 either regularly or irregularly. Again, the developing roller 5 is produced by spraying Teflon onto the conductive base 10 in such a manner as to form undulations, applying polystyrene, and then grinding the resulted laminate. On the other hand, the foamed body (or fur brush) 15 of the toner supply roller, or charging means, 6 is implemented by foam polyurethane or polystyrene which is the same or substantially the same as polystyrene with respect to the frictional charging series. The rest of the construction is the same as the previous embodiments. The second dielectric substance, i.e., Teflon showing itself on the surface of the developing roller 5 has a diameter of, for example, 30 μm to 2,000 μm, preferably 50 μm to 500 μm. The toner has a particle size of 5 μm to 20 μm, for example. Such a toner is negatively charged in contact with the toner supply roller 6 and developing roller 5.

In this embodiment, the second dielectric substance (Teflon) 12 of the developing roller 5 is intensely negatively charged by the toner supply roller 6 (see FIG. 1) which rotates in contact with the developing roller 5. By contrast, the first dielectric substance 11 is substantially not charged despite the friction since it is the same or substantially the same as the toner supply roller 6 with respect to the frictional charging series. However, since the negatively charged second dielectric substance 12 adjoins the first dielectric substance 11, a positive charge is induced on the surface of the first dielectric substance 11, as shown in FIG. 11. As a result, electric fields are developed between the first and second dielectric substances 11 and 12, i.e., numerous closed microfields are developed in the vicinity of the surface of the developing roller 5. The positively charged toner 4 is intensely attracted by and deposited on the surface of the negatively charged second dielectric substance 12, but it is not attracted by the first dielectric substance 11 which is not charged. Consequently, the attraction acting on the toner differs from one portion to another as measured on the surface of the developing roller 5, depending on the kind of the dielectric substance.

In this embodiment, too, the developing roller 5 retains a great amount of sufficiently charged toner thereon due to the microfields and, therefore, forms high quality images. In addition, a small amount of toner is deposited even on the surface of the first dielectric substance 11 due to van der Waals' forces. Again, it is desirable that the second dielectric substance 12 which attracts the toner occupies 40% to 90% of the entire surface of the developing roller to collect a great amount of toner. While the charge induced on the surface of the dielectric substance 11 is usually located in close proximity to the dielectric substance, it will be induced even in the intermediate portion of the dielectric substance 11, depending on the surface configurations and sizes of the substances 11 and 12.

An experiment was conductive with the above construction, as follows.

Experiment 5

This experiment was conducted under the same conditions as in Experiment 2 except for the following conditions. The developing roller 5 was produced by spraying Teflon onto an aluminum tube in such a manner as to form undulations whose mean thickness was 100 μm, applying polystyrene, and then grinding the laminate such that the dielectric layer is 50 μm thick. Teflon occupied 65% of the entire surface of the developing roller 5 in area ratio. The toner supply roller 6 was implemented by a fur brush roller having a polystyrene brush, while the doctor blade 8 was constituted by a urethane rubber blade. As a result, a uniform toner layer having a mass of 1.1 mg/cm$^2$ and an amount of charge of +13 μc/g and produced images having desirable tones and clear-cut lines.

Figure 12:
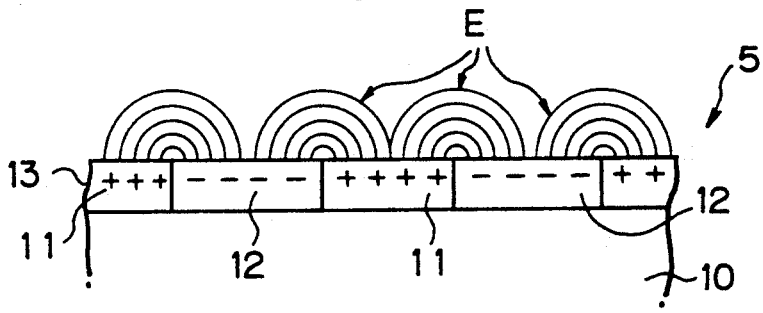
FIG. 12 shows lines of electric force on the surface of a developing roller.
Figure 13:
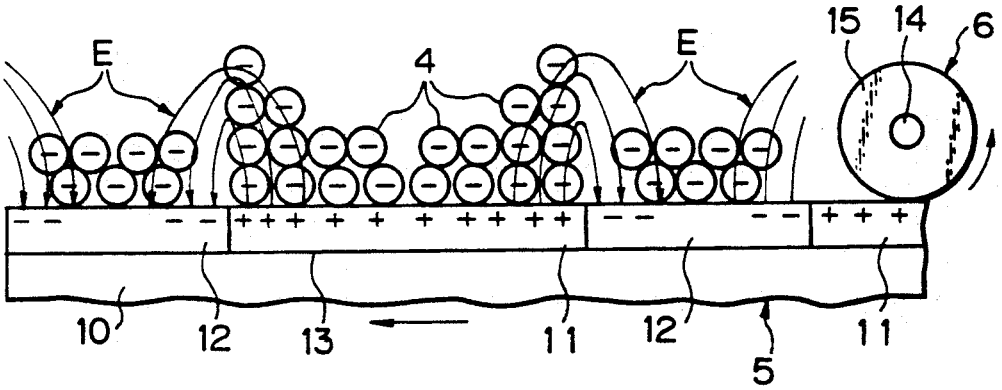

FIG. 13 shows an alternative configuration of the developing roller 5 shown in FIGS. 11 and 12. As shown, the first dielectric substance 11 comprises polycarbonate while the second dielectric substance 12 comprises polystyrene which greatly differs from polycarbonate with respect to the frictional charging series. The foamed body (or fur brush) 15 of the toner supply roller, or charging means, 6 is constituted by foam polyurethane which is the same or substantially the same as the second dielectric substance 12 with respect to the charging series. The toner supply roller 6 charges the first dielectric substance (polycarbonate) positively and substantially does not charge the second dielectric substance (polystyrene). In this case, the toner 4 is negatively charged by the friction thereof with the toner supply roller 6 and developing roller 5. In this configuration, too, a negative charge is induced on the surface of the second dielectric substance 12, and numerous microfields are developed in the vicinity of the surface of the developing roller 5. The negatively charged toner 4 deposits in a great amount on the surface of the positively charged first dielectric substance 11 and in a small amount on the second dielectric substance 12 due to van der Waals' forces. In this manner, the developing roller shown in FIG. 13 is successful in achieving the same advantages as the developing roller shown in FIGS. 11 and 12. The developing roller of FIG. 13 is produced by applying polycarbonate to the surface of the conductive base 10 in such a manner as to form undulations, applying polystyrene, and then grinding the laminate. Then, polycarbonate will be distributed in polystyrene on the surface of the developing roller 5. The fractions of the first dielectric substance (polycarbonate) 11 each has a diameter of, for example, 30 μm to 2,000 μm, preferably 50 μm to 500 μm, and collects the negatively charged toner whose particle size is 5 μm to 20 μm. The surface of the second dielectric substance 12 which collects a smaller amount of toner occupies 10% to 60% of the entire surface of the developing roller 5.

An experiment was conducted with the above construction, as follows.

Experiment 6

This experiment was conducted under substantially the same conditions as Experiment 1 except for the following conditions. Specifically, polystyrene was substituted for fluoric resin applied from above polycarbonate. The toner supply roller 6 was implemented by a polystyrene brush, while the doctor blade 8 was constituted by a urethane rubber blade. As a result, a uniform toner layer having a mass of 1.1 mg/cm$^2$ and an amount of charge of −12 μc/g was formed on the developing roller to realize images having desirable tones and clear-cut lines.

Alternatively, the dielectric substances of the charge holding layer 13 may be comprised of silicone resin and Teflon, and the fur brush of the toner supply roller 6 may be formed of Teflon. Then, the toner supply roller 6 will charge the silicone resin positively and substantially not charge Teflon and, instead, induce a negative charge. The negatively charged toner will be intensely retained on the silicon resin of the developing roller 5 and deposited in a small amount on Teflon. This is comparable with the embodiments of FIGS. 11 to 13 regarding the advantages.

Hereinafter will be described the third construction. In this construction, a charge holding layer having a plurality of different kinds of dielectric substances each having a particular charging characteristic is provided on the conductive base of a developing roller such that the dielectric substances are exposed to the outside on the surface of the layer in a regular or irregular pattern. The dielectric substances are charged to different potentials of the same polarity by charging means, so that numerous microfields are developed in the vicinity of the surface of the developing roller. The toner, therefore, is retained on the roller surface by intensity which depends on the kind of dielectric substance.

Figure 14:
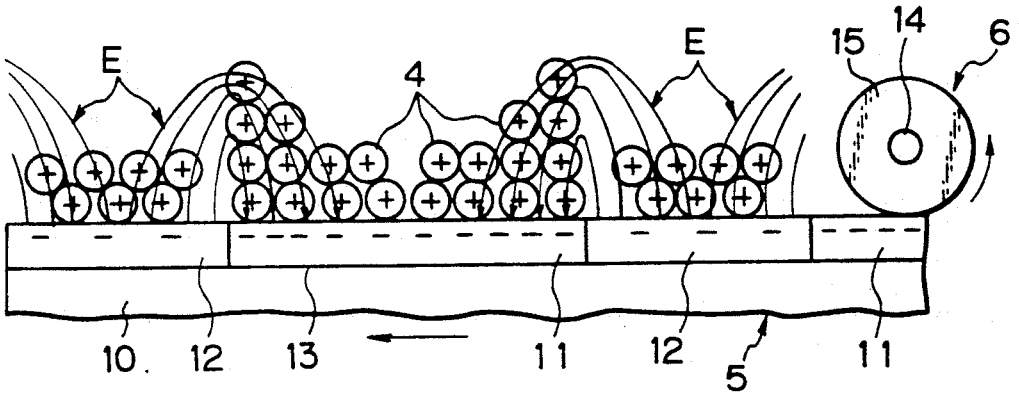
FIGS. 13 and 14 each is a schematic view showing closed microfields developed in the vicinity of the surface of a developing roller and a toner attracted thereby.

Specifically, as shown in FIG. 14, the charge holding layer 13 of the developing roller 5 is made up of the first and second dielectric substances 11 and 12, as in the previous embodiments. In this particular embodiment, the foamed body 15 of the toneer supply roller 6 which charges the substances 11 and 12 by friction assumes a position opposite in polarity to the substances 11 and 12 with respect to the charging sequence series, while the substances 11 and 12 are sufficiently remote from each other with respect to the frictional charging series. For example, the first and second substances 11 and 12 are comprises of polypropyrene and polystyrene, respectively, while the toner supply roller 6 is made of polyurethane or similar substance positioned at the more positive side than the substances 11 and 12 with respect to the charging series. Although both the first dielectric substance (polypropyrene) and the second dielectric substance (polystyrene) are negatively charged by the toner supply roller 6, the former is charged more intensely than the latter. As a result, a potential difference is developed between the surfaces of the two substances 11 and 12 to produce numerous closed microfields E. On the other hand, the toner 4 is positively charged by the toner supply roller 6 and developing roller 5 and electrostatically retained on the intensely charged first dielectric substance 11 due to the microfields. Consequently, the toner is attracted intensely in some portions of the surface of the roller 5 and less intensely in the other portions. Specifically, the toner is deposited in a great amount on the first dielectric substance 11 and in a small amount on the second dielectric substance 12 due to van der Waals' forces. This allows a great amount of sufficiently charged toner to be transported to the developing region 9, FIG. 1, to produce high quality images. Of course, the dielectric substances 11 and 12 may be positively charged but to different potentials in order to deposit a negatively charged toner on the roller 5 by microfields. Then, the substance constituting the toner supply roller 6 will be positioned at the more negative side than the substances 11 and 12 with respect to the charging series.

In the embodiments described above, the toner is deposited in the portions of the developing roller 5 which are charged to the opposite polarity to the toner. Alternatively, in the first and second constructions, the dielectric substance charged to the same polarity as the toner may repulse the toner while the other dielectric substance may attract it.

Figure 15:
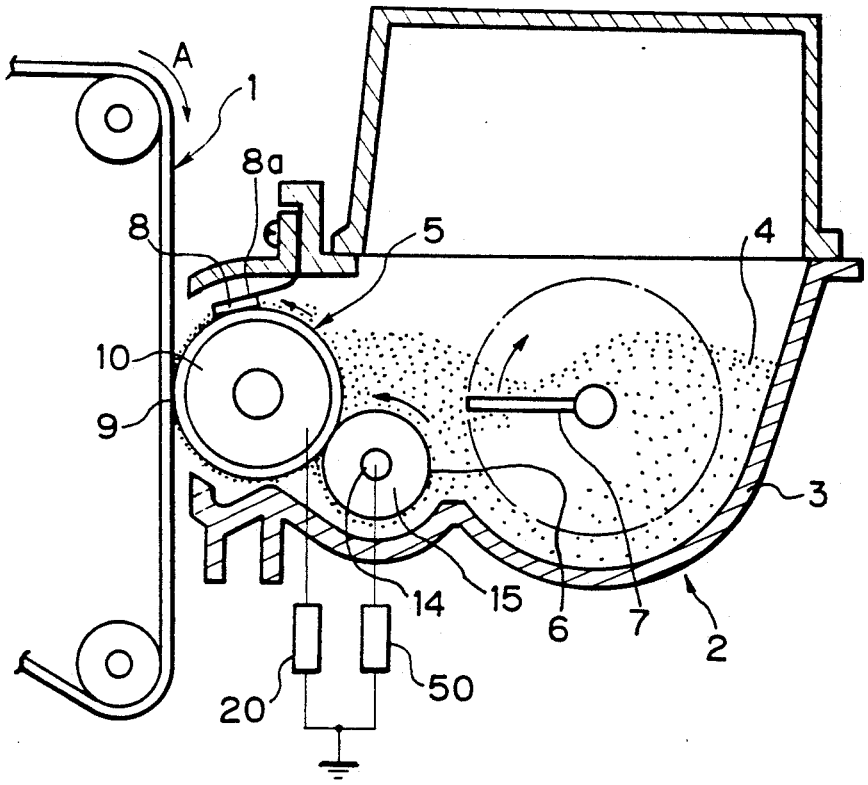
FIG. 15 is a section showing an embodiment different from the embodiment of FIG. 1.
Figure 16:
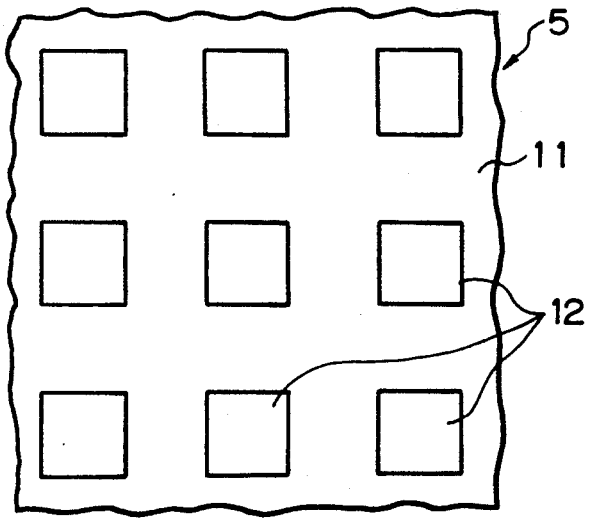
FIG. 16 is n enlarged plan view of a developing roller.
Figure 17:
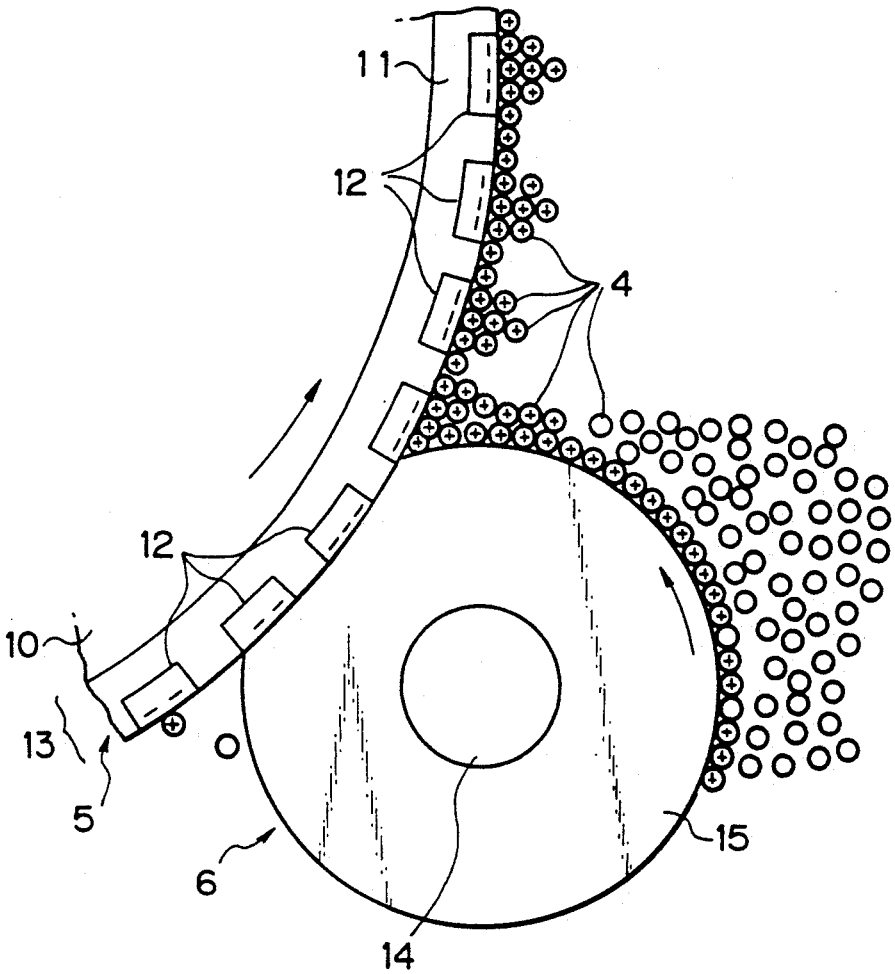
FIG. 17 is a view similar to FIG. 2, showing an embodiment different from the embodiment of FIG. 2.

FIGS. 15 to 17 show another specific configuration of the developing device which is applicable to any one of the embodiments implemented with the first to third constructions described above.

As shown in FIG. 15, the image carrier 1 is implemented as a belt which is driven in a direction indicated by an arrow A. As FIG. 17 indicates, the developing roller 5 has the conductive base in the form of a roller 10, the first dielectric substance 11 formed on the conductive base 10 in a layer having a uniform thickness, and the second dielectric substance 12 embedded in the substance 11 and different in frictional charging characteristic from the latter. The fractions of the second dielectric substance 12 show themselves on the surface of the first dielectric substance in a regular or irregular pattern, and each has a small area. The two substances 11 and 12 constitute the charge holding layer 13 in combination.

Figure 18:
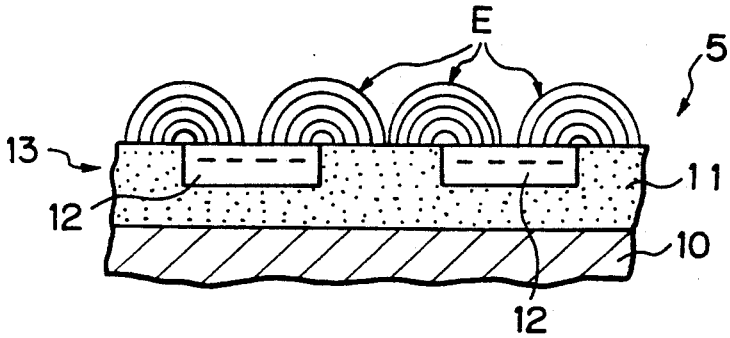
FIG. 18 shows lines of electric force on the surface of a developing roller.

FIG. 16 is a fragmentary enlarged external view of the developing roller 5. As shown, the fractions of the second dielectric substance 12 have a square shape and are arranged regularly at a predetermined pitch. The foamed body (or fur brush) of the toner supply roller 6 which contacts the developing roller 5 is the same as that of any of the previous embodiments or is suitably selected based on the same principle. For example, when the dielectric substances 11 and 12 comprise respectively silicone resin and Teflon which are sufficiently remote from each other with respect to the frictional charging series, the developing roller 5 may be produced by applying silicone resin to the conductive base 10 to a thickness of about 500 μm, and then burying the fragments of Teflon each being, for example 30 μm to 2,000 μm square, preferably 50 μm to 500 μm square, and 50 μm thick in the silicone resin by heat. In such a case, the foamed body (or fur brush) 15 of the toner supply roller may be comprised of silicone resin. Then, the foamed body 15 will charge the second dielectric substance 12 negatively by friction and substantially not charge the first dielectric substance 11, thereby producing numerous microfields in the vicinity of the surface of the developing roller 5, as shown in FIG. 18. This allows, for example, a positively charged toner to deposit on the surface of the developer, producing high quality images. Alternatively, the first and second dielectric substances 11 and 12 may be respectively comprised of polyester and nylon, and the foamed body of the toner supply roller 6 may be comprised of nylon. Then, the foamed body (or fur brush) 15 will charged the dielectric substance 11 negatively and substantially not charge the dielectric substance 12, whereby microfields are developed. In this condition, a positively charged toner, for example, will be deposited in a great amount on the developing roller 5. Further, the dielectric substance 11 may be comprised of polyester while the dielectric substance 12 and toner supply roller 6 each may be comprised of polystyrene. Then, the dielectric substance 11 will be positively charged while the dielectric substance 12 will be substantially not changed, allowing a negatively charged toner to deposit in a great amount on the substance 11. As stated above, any suitable dielectric substances may be selected, as desired. It is preferable that the dielectric substance which strongly attracts the toner occupies 40% to 90% of the entire surface of the developing roller 6, with no regard to the substances selected.

The construction shown in FIG. 15 is essentially the same as the construction of 1 except for some points, as follows. The portion of the foamed body (or fur brush) 15 which contacts the developing roller 5 may be treated to have conductivity, as stated earlier. Then, a bias voltage may be applied from a power source 50, FIG. 15, to the toner supply roller 6 so as to apply a charge to the surface of the developing roller 5 by charge injection or discharge. This allows the intensity of the microfields and, therefore, the amount of toner to be transported to the developing region 9 to be controlled, as desired. It is possible, therefore, to produce an image having any desired quality. For example, when the fur brush of the toner supply roller 6 is made of polyethylene fibers, the fibers are treated for conductivity beforehand in such a manner as to have a specific volume resistivity of, for example, $10^4$ Ω·cm to $10^8$ Ω·cm. In this condition, a bias voltage is applied from the power source 50 to such a toner supply roller 6. The bias voltage may be implemented as DC, AC-superposed DC, etc. Regarding DC, the polarity may be the same as or opposite to the polarity of the frictional charge to be deposited on the developing roller 5. The gist is that the polarity and voltage are adequately selected to set up a desired microfield intensity.

A specific procedure which produces the developing roller 5 or similar developer carrier simply and at low cost will be described hereinafter.

Figure 19:
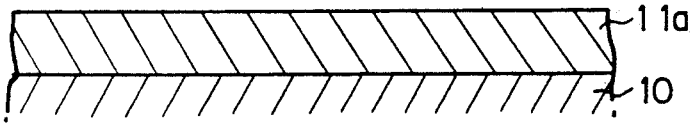
FIGS. 19 to 23 demonstrate a specific procedure for producing a developing roller.
Figure 20:
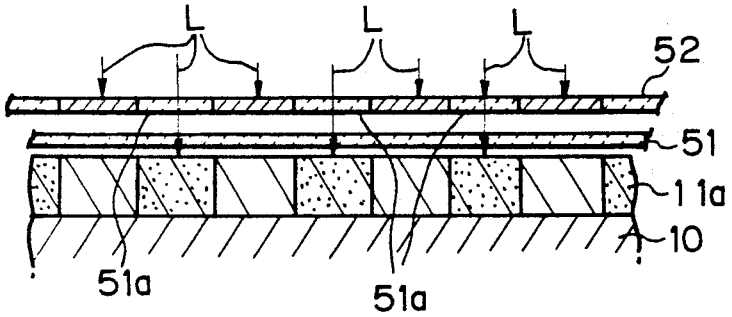
Figure 21:
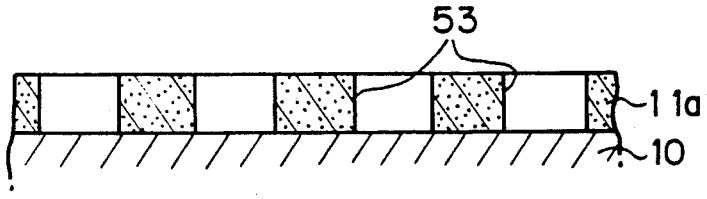
Figure 22:
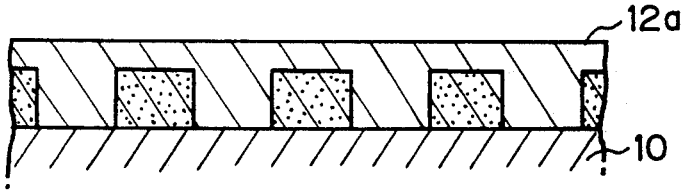
Figure 23:
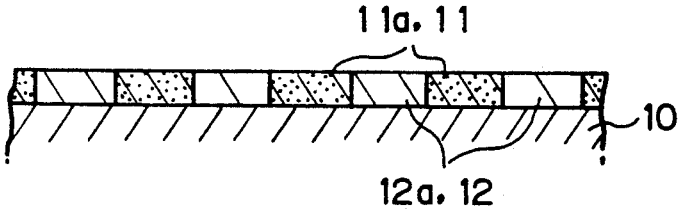

As shown in FIG. 19, the procedure begins with a step of applying unsaturated polyester or similar photosensitive (photobridging) first dielectric substance 11*a* to the entire periphery of the conductive base 10 implemented as a roller (or a belt). Then, as shown in FIG. 20, a contact screen 52 having, for example, one hundred screen lines are pressed against the first dielectric substance 11*a* with the intermediary of a transparent film 51. The contact screen 52 is a sheet having a great number of transmitting portions 51*a* which are arranged in a mesh pattern matching the second dielectric substance 12. The transparent film 51 intervening between the contact screen 52 and the first dielectric substance 11*a* prevents the substance 11*a* having fluidity from making contact with the contact screen 52. In this condition, the dielectric substance 11*a* is irradiated by light which causes photobridging to occur in the dielectric substance 11*a*, e.g., ultraviolet rays L via the contact screen 52. As a result, the dielectric substance 11*a* is exposed by the ultraviolet rays L transmitted through the transmitting portions 51*a* of the contact screen 52 and is hardened in such portions due to photobridging. The portions of the contact screen 52 other than the transmitting portions 51*a* intercept the rays L with the result that the corresponding portions of the dielectric substance 11*a* are not exposed and, therefore, maintain fluidity thereof. In FIG. 20, the exposed portions of the dielectric substance 11*a* are distinguished from the other portions by dots. After the exposure, the dielectric substance 11*a* is rinsed with the result that the portions of the substance 11*a* having not been exposed and, therefore, maintaining fluidity are washed away. Consequently, as shown in FIG. 21, numerous apertures 53 are formed through the dielectric substance 11*a* in a mesh pattern. Thereafter, as shown in FIG. 22, nylon or similar second dielectric substance 12*a* is applied to the first dielectric substance 11*a*, hardened, and then ground. The resulted developing roller 5 has the first and second dielectric substances 11*a* and 12*a*, i.e., the first and second dielectric substances 11 and 12 which show themselves on the surface of the roller 5, as shown in FIG. 23. In this case, the second dielectric substance or nylon 12 appears in the first dielectric substance or polyester 11 in a regular pattern. The size of the apertures 53, i.e., the size and shape of the dielectric material 12 and the area ratio of the dielectric substances 11 and 12 are open to choice and can be freely changed by changing the configuration and density of the transmitting portions 51*a*. Therefore, any desired charge pattern can be formed on the developing roller 5 during development.

The above-described procedure is advantageous over a procedure which sprays a first dielectric substance to the surface of a conductive base in such a manner as to form random undulations, applies a second dielectric substance to the first dielectric substance, and then grinds the surface of the resulted laminate. Specifically, the above-described procedure is capable of regulating the size of the fractions of the second dielectric substance as well as the area ratio of the first and second substances, thereby eliminating scattering at the production stage. Such a procedure is also practicable with dielectric substances other than the above-mentioned specific dielectric substances.

An experiment relating to the specific procedure stated above is as follows.

Experiment 7

This experiment was conducted under the same conditions as Experiment 1 except for the following conditions. Specifically, the developing roller was produced by applying unsaturated polyester to a conductive base implemented as an aluminum tube to a thickness of 100 μm, causing photobridging to occur locally in the polyester layer by ultraviolet rays, removing the portions of the polyester layer not undergone photobridging by rinsing, applying polystyrene to the polyester layer, and then grinding the surface of the laminate such that the dielectric layer is 50 μm thick. The polyester portion occupied 65% of entire surface of the resulted developing roller in area ratio. The toner supply roller, or charging member, was implemented by a fur brush made of polystyrene, while the doctor blade was made of urethane rubber. As a result, a uniform toner layer having a mass of 1.1 mg/cm$^2$ and an amount of charge of −12 μc/g was formed on the developing roller and successfully produced images having desirable tones and clear-cut lines.

While the embodiments shown and described each uses a toner supply roller as charging means for simplifying the construction, use may be made of charging means physically independent of the toner supply roller. When a developer carrier in the form of a belt is used, two different kinds of substances each having a particular frictional charging characteristic will be deposited on the conductive base of the belt.

The present invention is practicable with any kind of developing device using one-component developer constituted by a magnetic toner with or without an auxiliary agent or similar developer. Even when a magnetic developer is used, the present invention eliminates the need for magnets otherwise accommodated in the developer carrier to attract the developer and thereby simplifies the construction. In addition, when use is made of a non-magnetic toner as in the embodiments, the present invention substantially prevents the toner from being scattered around.

In summary, in accordance with the present invention, numerous closed microfields are developed in the vicinity of the surface of a developer carrier to electrostatically retain a great amount of developer on the developer carrier, insuring high quality images. A developer supply member plays the role of charging means to simplify the construction of a developing device. The intensity of microfields and, therefore, the amount of developer to be carried on the developer carrier can be controlled with ease. The surface potential of the developer carrier is increased, and fluoric resin forming the surface of the developer carrier prevents a toner from filming on the developer carrier. A plurality of different kinds of substances provided on the developer carrier are effectively charged. The developer carrier with such advantages can be produced simply and at low cost. Further, the area ratio, configurations, and sizes of the substances each having a particular frictional charging characteristic can be selected, as desired.

Various modifications will become possible for those skilled in the art after receiving the teachings of the present disclosure without departing from the scope thereof.

What is claimed is:

1. A developer carrier for carrying a developer on a surface thereof where numerous microfields are developed, comprising:

a conductive base; and a plurality of kinds of substances each having a particular charging characteristic and being exposed to the outside on a surface of said conductive base in a predetermined pattern;

said plurality of kinds of substances being charged in a predetermined manner to produce the numerous microfields in the vicinity of said surface of said developer carrier, said microfields defining attracting portions which attract the developer and repulsing portions which repulse the toner on said surface of said developer carrier.

2. A developer carrier as claimed in claim 1, wherein said predetermined pattern in which said plurality of kinds of substances are exposed is a regular pattern.

3. A developer carrier as claimed in claim 1, wherein said predetermined pattern in which said plurality of kinds of substances are exposed is an irregular pattern.

4. A developer carrier as claimed in claim 1, wherein at least one of said plurality of kinds of substances is charged in said predetermined manner.

5. A developer carrier as claimed in claim 4, wherein said predetermined manner is such that said one substance is charged to a polarity opposite to or identical with a polarity of said developer.

6. A developer carrier as claimed in claim 4, wherein an attracting force exerted by said attracting portions to attract the developer varies in accordance with the kind of said substance.

7. A developer carrier as claimed in claim 1, wherein at least two of said plurality of kinds of substances are charged in said predetermined manner.

8. A developer carrier as claimed in claim 7, wherein said repulsing portions occupy 10% to 60% of said surface of said developer carrier in terms of area ratio.

9. A developer carrier as claimed in claim 1, wherein said predetermined manner is such that said plurality of kinds of substances each is charged to a particular polarity.

10. A developer carrier as claimed in claim 1, wherein said predetermined manner is such that said plurality of kinds of substances are charged to potentials of the same polarity.

11. A developing device for supplying a developer to a developing region of an image carrier to develop a latent image electrostatically formed on said image carrier, comprising:

a developer carrier comprising a conductive base and a plurality of kinds of substances each having a particular charging characteristic and being exposed to the outside on a surface of said conductive base in a predetermined pattern, said plurality of kinds of substances being charged in a predetermined manner to thereby produce numerous microfields in the vicinity of a surface of said developer carrier, said microfields defining attracting portions which attract the developer and repulsing portions which repulse the toner; and charging means for charging said plurality of kinds of substances of said developer carrier.

12. A developing device as claimed in claim 11, wherein said charging means charges at least one of said plurality of kinds of substances.

13. A developing device as claimed in claim 12, wherein said charging means comprises a developer supply member held in contact with said surface of said developer carrier for charging at least one of said plurality of kinds of substances and supplying the developer to said developer carrier.

14. A developing device as claimed in claim 11, further comprising voltage applying means for applying a voltage to said charging means.

15. A developing device as claimed in claim 11, wherein said charging means is made of at least one substance.

16. A developing device as claimed in claim 15, wherein said substance constituting said charging means assumes an intermediate position between said plurality of kinds of substances of said developer carrier with respect to the frictional series.

17. A developing device as claimed in claim 16, wherein one of said plurality of kinds of substances of said developer carrier comprises fluoric resin and a substance dispersed in said fluoric resin, said substance dispersed in said flouric resin being different in charging characteristic from said fluoric resin, said fluoric resin and said substance being exposed to the outside of said surface of said developer carrier for attacking a charged developer onto said developer carrier.

18. A developing device as claimed in claim 16, wherein said purality of kinds of substances of said developer carrier comprise fluoric resin and polycarbonate dispersed in said fluoric resin which are exposed to the outside on said surface of said developer carrier;

said substance constituting said charging means comprising polystyrene or polyurethane;

the developer being positively charged and attracted onto said surface of said developer carrier.

19. A developing device as claimed in claim 16, wherein said plurality of kinds of substances of said developer carrier comprises polycarbonate and fluoric resin dispersed in said polycarbonate which are exposed to the outside on said surface of said developer carrier;

said substance constituting said charging means comprising polystyrene or polyurethane;

the developer being negatively charged and attracted onto said surface of said developer carrier.

20. A developing device as claimed in claim 15, wherein said substance constituting said charging means being identical or substantially identical with one of said plurality of substances of said developer carrier with respect to the frictional charging series.

21. A developing device as claimed in claim 20, wherein said plurality of kinds of substances of said developer carrier comprise polystyrene and fluoric resin dispersed in said polystyrene which are exposed to the outside on said surface of said developer carrier;

said substance constituting said charging means comprising polystyrene;

the developer being positively charged and attracted onto said surface of said developer carrier.

22. A developing device as claimed in claim 20, wherein said plurality of kinds of substances of said developer carrier comprise polystyrene and polycarbonate dispersed in said polystyrene which are exposed to the outside on said surface of said developer carrier;

said substance constituting said charging means comprising polystyrene;

the developer being negatively charged and attracted onto said surface of said developer carrier.

23. A developing device as claimed in claim 15, wherein said substance constituting said charging means assumes a position on the opposite polarity side to said plurality of kinds of substances of said developer carrier with respect to the charging series, said plurality of kinds of substances being sufficiently remote from each other with respect to the frictional charging series.

24. A developing device as claimed in claim 11, wherein said charging means is made of at least two kinds of substances each having a particular frictional charging characteristic.

25. A method of producing a developer carrier for carrying a developer on a surface thereof where numerous microfields are developed, comprising the steps of:

(a) applying a photosensitive first substance to a surface of a conductive base;

(b) irradiating said first substance by light which causes photobridging to occur in said first substance via a contact screen;

(c) removing portions of said first substance not undergone photobridging by ringing;

(d) applying a second substance to a surface of said first substance; and (e) grinding a surface of said second substance after said substance has been hardened.

26. A developer carrier for carrying a developer on a surface thereof where numerous microfields are developed, comprising:

a conductive base; and a plurality of kinds of substances each having a particular charging characteristic and being exposed to the outside on a surface of said conductive base in a predetermined pattern;

said plurality of kinds of substances being charged in a predetermined manner to produce the numerous microfields in the vicinity said surface of said developer carrier.

27. A developer carrier as claimed in claim 26, wherein said microfields define first portions which are charged to a polarity identical with a polarity of the developer and second portions which are charged to a polarity opposite to a polarity of the developer.

28. A developer carrier as claimed in claim 27, wherein said first portions comprise attracting portions for attracting the developer and said second portions comprise repulsing portions for repulsing the toner on said surface of said developer carrier.

29. A developer carrier as claimed in claim 28, wherein said predetermined pattern in which said plurality of kinds of substances are exposed is a regular pattern.

30. A developer carrier as claimed in claim 28, wherein said predetermined pattern in which said plurality of kinds of substances are exposed is an irregular pattern.

31. A developer carrier as claimed in claim 28, wherein at least one of said plurality of kinds of substances is charged in said predetermined manner.

32. A developer carrier as claimed in claim 31, wherein said predetermined manner is such that said one substance is charged to a polarity opposite to or identical with a polarity of said developer.

33. A developer carrier as claimed in claim 31, wherein an attracting force exerted by said attracting portions to attract the developer varies in accordance with the kind of said substance.

34. A developer carrier as claimed in claim 28, wherein at least two of said plurality of kinds of substances are charged in said predetermined manner.

35. A developer carrier as claimed in claim 34, wherein said repulsing portions occupy 10% to 60% of said surface of said developer carrier in terms of area ratio.

36. A developer carrier as claimed in claim 28, wherein said predetermined manner is such that said plurality of kinds of substances each is charged to a particular polarity.

37. A developer carrier as claimed in claim 28, wherein said predetermined manner is such that said plurality of kinds of substances are charged to potentials of the same polarity.

38. A developing device for supplying a developer to a developing region of an image carrier to develop a latent image electrostatically formed on said image carrier, comprising:

a developer carrier comprising a conductive base and a plurality of kinds of substances each having a particular charging characteristic and being exposed to the outside on a surface of said conductive base in a predetermined pattern, said plurality of kinds of substances being charged in a predetermined manner to thereby produce numerous microfields in the vicinity of a surface of said developer carrier.

39. A developing device as claimed in claim 38, wherein said microfields define first portions which are charged to a polarity identical with a polarity of the developer and second portions which are charged to a polarity opposite to a polarity of the developer.

40. A developing device as claimed in claim 39, wherein said first portions comprise attracting portions for attracting the developer and said second portions comprise repulsing portions for repulsing the toner on said surface of said developer carrier, and charging means for charging said plurality of kinds of substances of said developer carrier.

41. A developing device as claimed in claim 40, wherein said charging means charges at least one of said plurality of kinds of substances.

42. A developing device as claimed in claim 41, wherein said charging means comprises a developer supply member held in contact with said surface of said developer carrier for charging at least one of said plurality of kinds of substances and supplying the developer to said developer carrier.

43. A developing device as claimed in claim 40, further comprising voltage applying means for applying a voltage to said charging means.

44. A developing device as claimed in claim 40, wherein said charging means is made of at least one substance.

45. A developing device as claimed in claim 44, wherein said substance constituting said charging means assumes an intermediate position between said plurality of kinds of substances of said developer carrier with respect to the frictional charging series.

46. A developing device as claimed in claim 45, wherein one of said plurality of kinds of substances of said developer carrier comprises fluoric resin and a substance dispersed in said fluoric resin, said dispersed substance being different in charging characteristic from said fluoric resin, said fluoric resin and said substance being exposed to the outside on said surface of said developer carrier for attracting a charged developer onto said developer carrier.

47. A developing device as claimed in claim 45, wherein said plurality of kinds of substances of said developer carrier comprise fluoric resin and polycarbonate dispersed in said fluoric resin which are exposed to the outside on said surface of said developer carrier, said substance constituting said charging means comprising polystyrene or polyurethane, the developer being positively charged and attracted onto said surface of said developer carrier.

48. A developing device as claimed in claim 45, wherein said plurality of kinds of substances of said developer carrier comprises polycarbonate and fluoric resin dispersed in said polycarbonate which are exposed to the outside on said surface of said developer carrier, said substance constituting said charging means comprising polystyrene or polyurethane, the developer being negatively charged and attracted onto said surface of said developer carrier.

49. A developing device as claimed in claim 44, wherein said substance constituting said charging means being identical or substantially identical with one of said plurality of substances of said developer carrier with respect to the frictional charging series.

50. A developing device as claimed in claim 49, wherein said plurality of kinds of substances of said developer carrier comprise polystyrene and fluoric resin dispersed in said polystyrene which are exposed to the outside on said surface of said developer carrier, said substance constituting said charging means comprising polystyrene, the developer being positively charged and attracted onto said surface of said developer carrier.

51. A developing device as claimed in claim 49, wherein said plurality of kinds of substances of said developer carrier comprise polystyrene and polycarbonate disposed in said polystyrene which are exposed to the outside on said surface of said developer carrier, said substance constituting said charging means comprising polystyrene, the developer being negatively charged and attracted onto said surface of said developer carrier.

52. A developing device as claimed in claim 44, wherein said substance constituting said charging means assumes a position on the opposite polarity side to said plurality of kinds of substances of said developer carrier with respect to the charging series, said plurality of kinds of substances being sufficiently remote from each other with respect to the frictional charging series.

53. A developing device as claimed in claim 40, wherein said charging means is made of at least two kinds of substances each having a particular frictional charging characteristic.

* * * * *